US006371585B2

(12) United States Patent
Kurachi

(10) Patent No.: US 6,371,585 B2
(45) Date of Patent: Apr. 16, 2002

(54) RING MARK PRINTING DEVICE FOR IDENTIFYING ELECTRICAL CABLES

(75) Inventor: Hisashi Kurachi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/766,598

(22) Filed: Jan. 23, 2001

(30) Foreign Application Priority Data

Jan. 24, 2000 (JP) ..... 2000-013753

(51) Int. Cl.[7] ..... B41J 3/00; B41F 17/00
(52) U.S. Cl. ..... 347/2; 101/36
(58) Field of Search ..... 347/2, 4; 118/67, 118/68, 314, 323; 101/35–37, 75, 109, 426

(56) References Cited

U.S. PATENT DOCUMENTS

| | | | | |
|---|---|---|---|---|
| 2,989,943 A | | 6/1961 | Fitzgerald et al. | 118/314 |
| 4,056,343 A | * | 11/1977 | Kaiser et al. | 101/37 |
| 4,313,394 A | | 2/1982 | North et al. | 118/323 |
| 5,813,325 A | * | 9/1998 | Descovich | 101/36 |

FOREIGN PATENT DOCUMENTS

| | | | |
|---|---|---|---|
| FR | 1285523 | 7/1962 | |
| JP | 55-65710 | 10/1978 | |
| JP | 61-60413 | 4/1986 | ..... H01B/13/00 |
| JP | 4-163048 | 6/1992 | ..... B41J/2/01 |
| JP | 7-25517 | 5/1995 | ..... H01B/13/00 |

* cited by examiner

*Primary Examiner*—John Barlow
*Assistant Examiner*—Juanita Stephens
(74) *Attorney, Agent, or Firm*—Greenblum & Bernstein, P.L.C.

(57) ABSTRACT

A ring-mark printing device for identifying electrical cables includes a printer box having a feed axis and configured to pass an electrical cable along the feed axis. The printer box includes an ink shield including a concentrically arranged double structured tube. The double structured tube includes an outer tubular body, and an inner tubular body, the inner tubular body being held such that it can freely slide within the outer tubular body. The outer tubular body includes outer ink-orifices at positions facing marking drums. The inner tubular body also includes inner ink-orifices. By sliding the inner tubular body, an inner ink-orifice can be joined with an outer ink-orifice, so that the electrical cable is ready to be printed with ink ejected from the marking drum, or the inner orifice can be moved away from the outer ink-orifice, so that the electrical cable is impeded from printing. In this manner, production of substandard electrical cable is greatly reduced, and running rates of the production line is improved. Further, the operation process is suitably adapted to a small lot production.

20 Claims, 11 Drawing Sheets

RING MARK PRINTING DEVICE FOR IDENTIFYING ELECTRICAL CABLES

BACKGROUND OF THE INVENTION

1. Field of the Invention

The invention relates to a ring-mark printing device for identifying electrical cables. When ring marks are to be painted on the circular surface of an electrical cable, the operation is preferably carried out under non-contact conditions. The electrical cables painted with ring marks are usually employed in the automobile industry, and the ring marks serve to distinguish the quality and/or size of such cables.

2. Description of Background Information

Known ring-mark printing devices usually employ either a printing system in which ink is ejected through ink nozzles under pressure and painted on a cable surface, or a system in which a marking drum is provided with a tubular surface having ink nozzles, through which ink is ejected by the centrifugal force exerted by drum rotation.

An example of the former (first) printing system is disclosed in a Japanese utility model application published under No. SHO 61-60413, and an example of the latter (second) system is disclosed in a Japanese utility model application published under No. HEI 7-25517.

FIG. 1 shows process steps performed by the second printing system, in which an electrical cable is manufactured and then painted with ring-like marks. In this system, a conductor wire 2 is continuously supplied from a supply reel 1 along a predetermined path. The conductor wire 2 is then passed through an extruding machine 3 and coated while being extruded, thereby yielding a coated electrical cable 4. The coated electrical cable 4 is guided into a printer machine 5, in which the cable is painted with ring-like marks used for cable identification. The marked electrical cable 4 is cooled in a cooling bath 6, withdrawn through a withdrawal unit 7, and reeled continuously around a receiving reel 8.

FIGS. 2, 3 and 4 illustrate the following device units: a printer box 10, in which the electrical cable 4 is subjected to a printing operation; a pair of marking drums 11 and 12 mounted in the printer box 10, the two marking drums being arranged sequentially along the cable's feed axis, and in staggered positions and at some distance relative to the feed axis; a driving mechanism for rotating both marking drums 11 and 12 (not shown in the figures); an ink tank 13 for storing marking ink; an ink-supply mechanism for feeding ink from the ink tank 13 to inside the marking drums 11 and 12 through a supply pipe 14; and an ink return pipe 15 for forwarding the ink contained in the printer box 10 to the ink tank 13.

As shown in FIGS. 5 and 6, the marking drums 11 and 12 respectively include a plurality of ink-jet nozzles (six nozzles in the illustrated example) arranged at a given interval in the circumferential direction of the tubular surface. The ink 16 stored in the marking drum 11 is ejected through each ink-jet nozzle, by virtue of the centrifugal force generated by the rotating drum, so that each half side face of the electrical cable 4, when advancing along the feed axis P, is painted with ejected ink.

FIGS. 3 to 7 show the marking process in detail. When the electrical cable 4 advances along the feed axis P of the cable and passes in front of a first marking drum 11, a first semicircular side face of the cable 4 is painted with ink 16 ejected from the marking drum 11 placed upstream, and is printed with a semicircular mark 17*a* (FIG. 5). Likewise, when the electrical cable 4 advances further and passes in front of a second marking drum 12 placed downstream, a second semicircular side face of the cable 4 is painted with ink 16 ejected from the marking drum 12, and is printed with a semicircular mark 17*b* (FIG. 6). In this manner, the outer circular face of the electrical cable 4 can be printed with complete ring marks 17 (or band marks) at a given interval.

In order to match the position of the first semicircular mark 17*a* with that of the second semicircular mark 17*b*, the marking drums 11 and 12 are driven in synchronization.

In such a centrifugal printing system, equipment is designed with the presumption that the ink 16 continues to be ejected correctly. Accordingly, when electrical cables 4 with and without ring marks are produced in the same production line, either the printer device 5 is cut off, or a special ink-shield is installed for deviating ejected ink 16 from the electrical cable 4.

Thus, when the centrifugal printing system is applied, the printer device 5 may optionally be turned off when the electrical cables are to be processed without printing. However, this switching off process involves a certain time lag before the rotational speed of the marking drums 11 and 12 can be lowered to a point where the ink 16 stops jetting out. As a result, the portion of electrical cables 4 processed during the switching off time must be cast aside as a substandard product. Conversely, when the marking drums 11 and 12 are again put into motion, it takes a while to regain full rotational speed and stability. The portion of electrical cables 4 produced during this period must also be cast aside as a substandard product. Those substandard products formed during the restarting period may reach several kilometers of the electrical cable 4, which is cast aside as a length loss.

When the marking drums 11 and 12 are immobile for a long time (the standstill duration limit being several minutes to some fifteen minute), ink 16 solidifies inside the ink-jet nozzles. The disassembling and cleaning of the nozzles will thus become necessary when the marking drums are to be started.

When a special ink shield is used, it must be replaced during a replacement standstill. Such a standstill incurs of course the production of substandard electrical cables, resulting in a length loss of several hundred meters. Moreover, ink 16 may be spattered around from the marking drums 11 and 12 while the shield is replaced, and may smear peripheral equipment. As the ink 16 contains organic solvents, the working environments are also deteriorated.

Moreover, when the shield is replaced, it may inadvertently thrust the electrical cable 4, and cut it off.

In order to reduce such accidents, prior art solutions usually opted for preparing different production schedules, depending on whether electrical cables 4 are printed with ring marks or not. However, such production methods are not well suited to small-lot production and suffer from a low running rate of the production line.

SUMMARY OF THE INVENTION

In order to solve the above-noted problems, the present invention provides a ring-mark printing device for identifying electrical cables, which reduces the length loss of the electrical cables, improves the running rate of the production line of the cables, and is suited to small-lot production.

To this end, there is provided a ring-mark printing device for identifying electrical cables. The device includes a printer box having a feed axis and configured to pass an electrical cable along the feed axis and a pair of marking drums with a respective outer circular face. The marking drums are contained in the printer box and arranged in staggered positions along the feed axis and at a given distance away therefrom. Further, the marking drums include ink-jet nozzles at the outer circular face. Further yet, the marking drums are respectively adapted to contain ink and eject the ink through the ink-jet nozzles by virtue of centrifugal forces exerted by drum rotation, in order to print the ring-mark around the circular surface of the electrical cable.

According to the present invention, the printer box is provided with an ink shield including substantially concentrically positioned outer and inner tubular bodies which are configured to surround the electrical cable from a given distance. The outer tubular body further includes at least one outer ink-orifice at a position facing one of the marking drums and the inner tubular body includes at least one inner ink orifice.

The inner tubular body is then mounted such that it can slide through the outer tubular body along the feed axis in a freely movable way, and such that the inner ink-orifices can be joined with a corresponding outer ink-orifices to be ready for ring-mark printing, or moved away from a corresponding outer ink-orifice to be prevented from ring-mark printing.

Preferably, the outer tubular body is divided into three outer tubular segments by two outer ink-orifices, and the outer tubular segments are held by a shield support.

Further, the shield support may have an opening in a portion adjacent to the outer ink-orifices.

Suitably, the inner tubular body is divided into three inner tubular segments by two inner ink-orifices, and the inner tubular segments are connected to each other by a linking element.

More suitably, the outer and inner tubular bodies include a corresponding outer and inner longitudinal slit along a diametrically lowermost portion over the length of the corresponding body. The outer and inner longitudinal slits thus communicate with corresponding outer and inner ink-orifices. The outer and inner longitudinal slits communicate with each other and have a space sufficiently large for allowing the electrical cable to pass, such that the ink shield can be fitted into the printer box from the top thereof in a freely engageable and removable way.

The inner longitudinal slit may include first and second longitudinal rims, which are divided into corresponding first and second rim segments by the inner ink-orifices. In this arrangement, the first rim segments are placed farther, relative to one of the marking drums, than the second rim segments. The linking element is then mounted between two adjacent first rim segments.

Preferably, the inner tubular body includes at least one stop, such that, when the inner tubular body is slid through the outer tubular body, the at least one stop can determine one of a position ready for ring-mark printing and a position for impeding the ring-mark printing.

More preferably, the inner tubular body is longer than the outer tubular body, so that two end portions of the inner tubular body extend outwardly from two end portions of the outer tubular body along the feed axis, and the two end portions of the inner tubular body respectively carry first and second stops, such that the inner tubular body can determine a position ready for ring-mark printing and a position for impeding the ring-mark printing, by sliding the inner tubular body until one of the first and second stops abuts against the outer tubular body.

BRIEF DESCRIPTION OF THE DRAWINGS

The above and the other objects, features and advantages of the present invention will be made apparent from the following description of the preferred embodiments, given as examples, with reference to the accompanying drawings, in which.

DETAILED DESCRIPTION OF THE PREFERRED EMBODIMENTS

Figure 1:
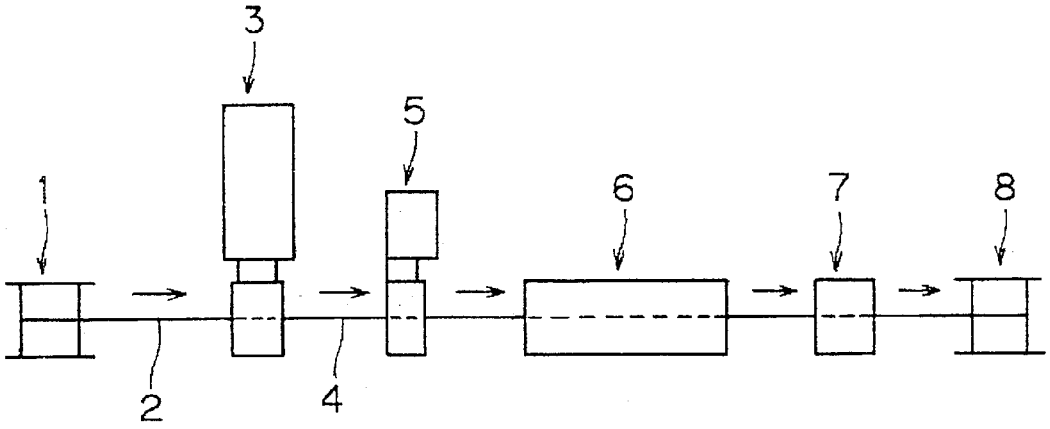
FIG.1 PRIOR ART
FIG. 1 is a flowchart representation of a prior art production line for ring-marked electrical cables
Figure 2:
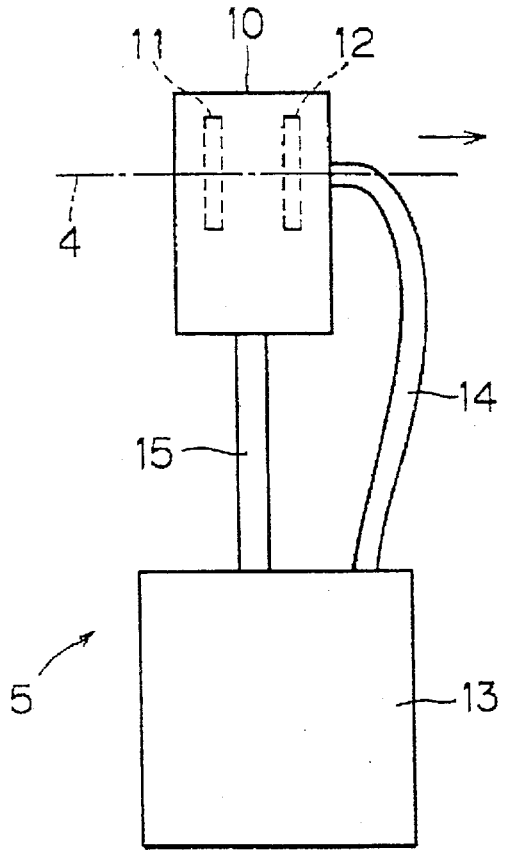
FIG.2 PRIOR ART
FIG. 2 is a side elevational view of a printing unit, mainly showing a printer box, contained in the production line of FIG. 1
Figure 3:
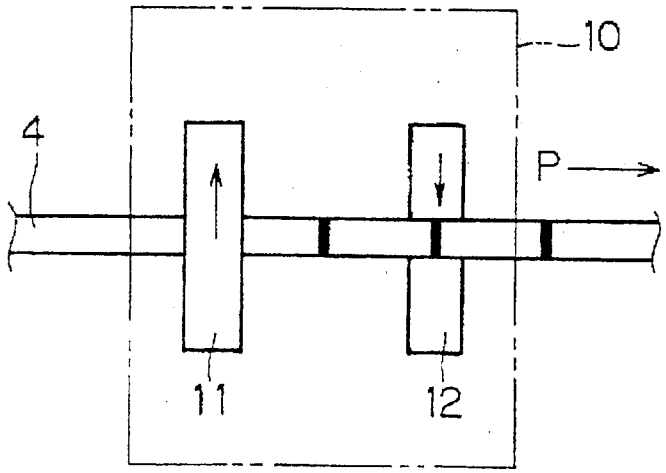
FIG.3 PRIOR ART
FIG. 3 is an interior view of the printer box of FIG. 2, mainly showing two marking drums.
Figure 4:
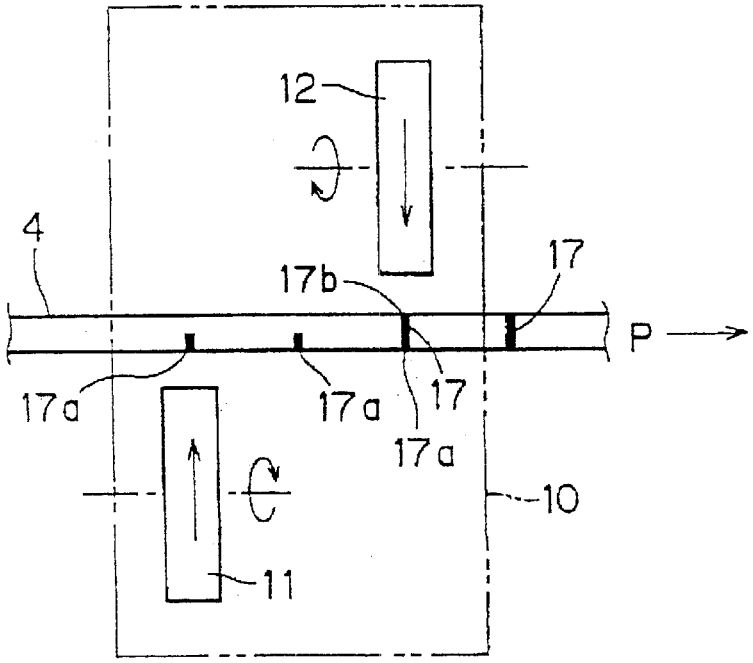
FIG.4 PRIOR ART
FIG. 4 is an interior top plan view of the printer box of FIG. 3.
Figure 5:
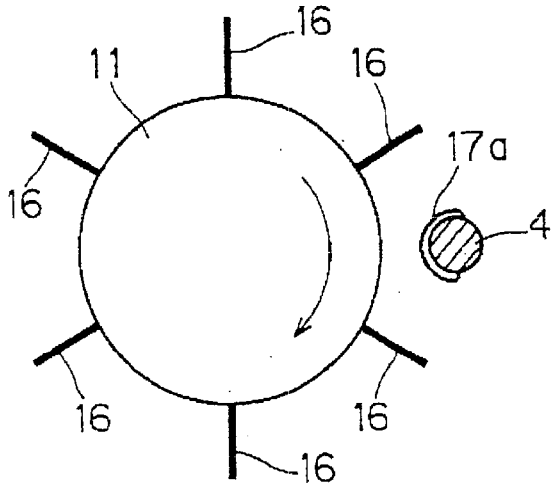
FIG.5 PRIOR ART
FIG. 5 is a side elevational view of a first marking drum of FIGS. 3 and 4, showing how a semicircular mark is printed.
Figure 6:
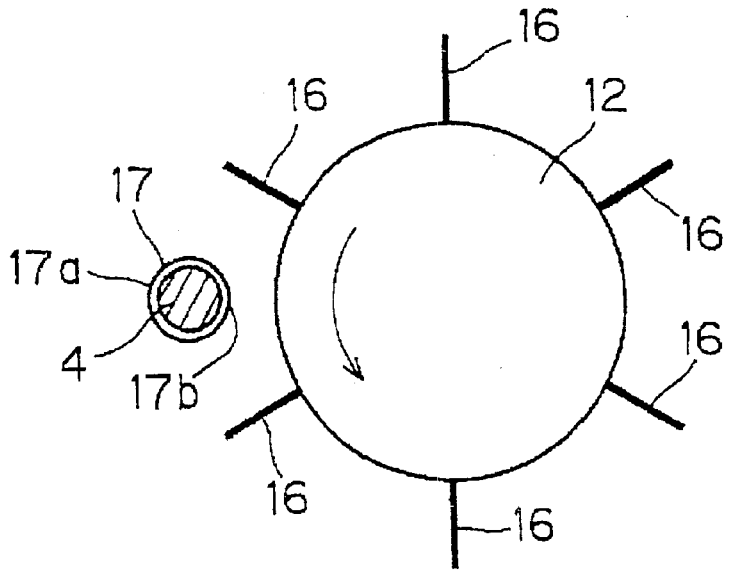
FIG.6 PRIOR ART
FIG. 6 is a side elevational view of a second marking drum of FIGS. 3 and 4, showing how a second semicircular mark is printed.
Figure 7:
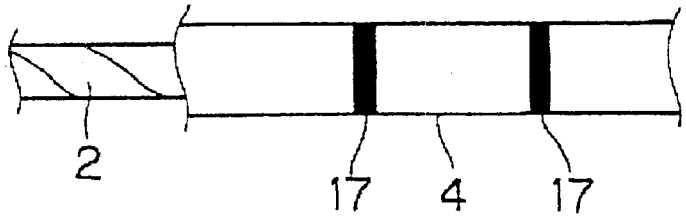
FIG.7 PRIOR ART
FIG. 7 is a side view of an electrical cable printed with ring marks.

An embodiment of the present invention uses a printing device 5 which can be as described with reference to the prior art (cf. FIG. 2), i.e. including a printer box 10 in which an electrical cable 4 is subjected to a mark printing; a pair of marking drums 11 and 12 provided in the printer box 10, both drums 11 and 12 being placed sequentially along the feed axis P of the electrical cable 4 and being in a staggered position and at a given distance with respect to the feed axis; a driving mechanism (not shown) for rotating the pair of marking drums 11 and 12; an ink tank 13 for storing ink 16; an ink supply mechanism for supplying ink from the ink tank 13 into the marking drums 11 and 12 through a supply pipe 14; and an ink return pipe 15 for returning the ink 16 filling the printer box 10 into the ink tank.

The marking drums 11 and 12 are respectively provided with a plurality of ink-jet nozzles (six in the present case) arranged at a given interval in the circumferential direction of the marking drums 11 and 12. The ink 16 stored in the marking drums 11 and 12 is ejected through the ink-jet nozzles by virtue of the centrifugal forces exerted by rotating drums. As the electrical cable 4 progresses along the feed axis P, each half of its circular face is painted with the ejected ink.

Thus, as the electrical cable 4 moves along, a first semicircular side face thereof is painted with ink by the marking drum 11 located upstream, whereby a first semicircular mark 17*a* is formed. Likewise, a second semicircular side face of the cable 4 is painted with ink by the marking drum 12 located downstream, whereby a second semicircular mark 17*b* is formed.

The marking drums 11 and 12 are driven in a synchronized manner, such that the second semicircular mark 17*b* coincides with the first semicircular mark 17*a*, and the complete ring marks 17 thus formed are printed at given intervals over the length of the electrical cable 4.

As shown in FIGS. 8 to 16, according to the present invention, a shield groove 20 is provided in the printer box 10, such that the opening of the shield groove 20 extends from the top of the printer box 10 (see FIG. 8) down to below the feed axis P where the electrical cable 4 passes. The shield groove 20 is fitted with an ink shield 21 in a freely engageable and removable way. The ink shield 21 surrounds and protects the electrical cable 4 passing along the feed axis P.

The ink shield 21 includes a double-layered shield tube 22, and a shield support 23 in the form of a plate, which supports the shield tube 22.

Figure 8:
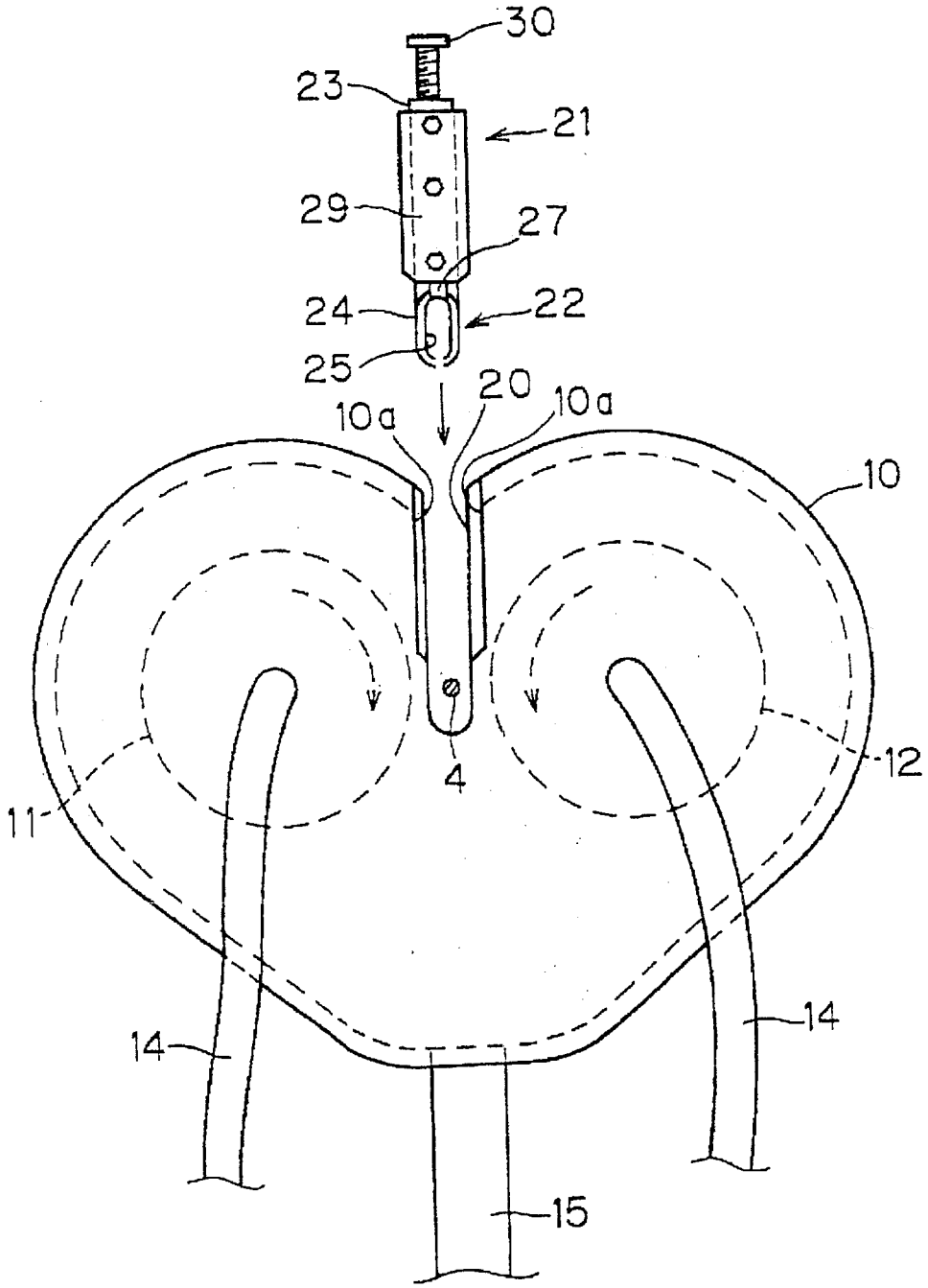
FIG. 8 is a side elevational view of a printing unit according to the present invention, when an ink shield is being fitted into a printer box.
Figure 9:
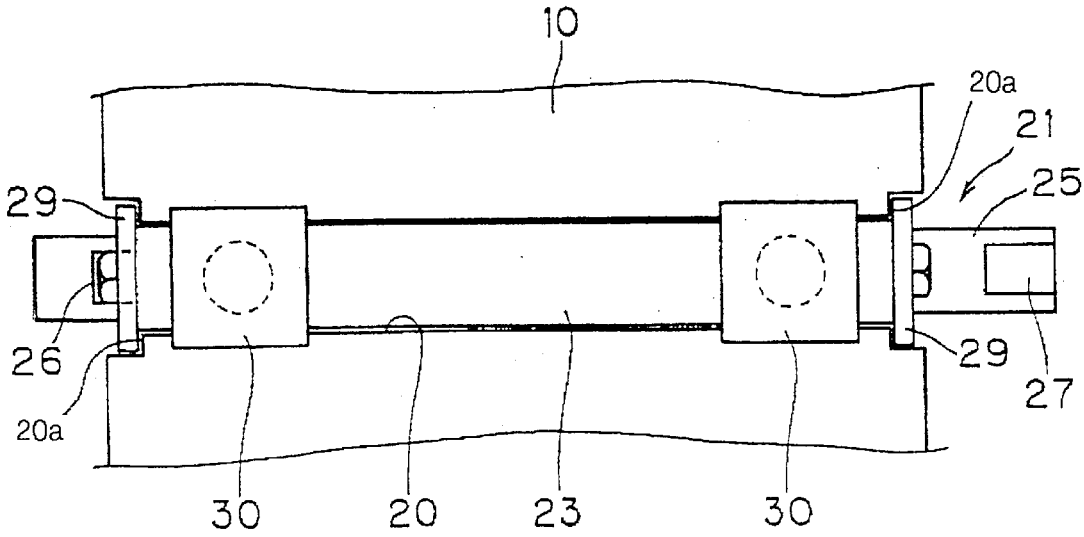
FIG. 9 is a top plan view of an ink shield, when it is fitted into the printing box.
Figure 10:
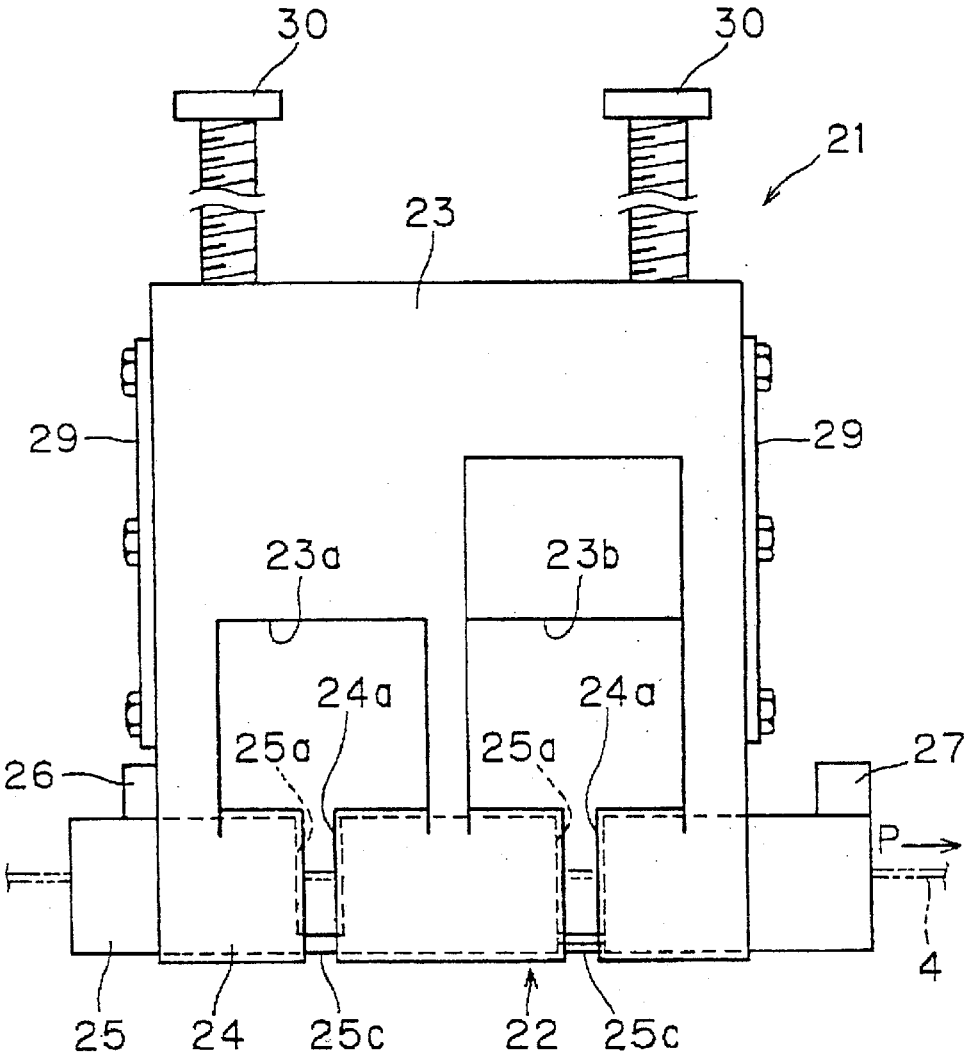
FIG. 10 is a side elevational view of the front face of an ink shield according to the invention, when the ink orifices of the outer tubular body and those of the inner tubular body are joined.
Figure 11:
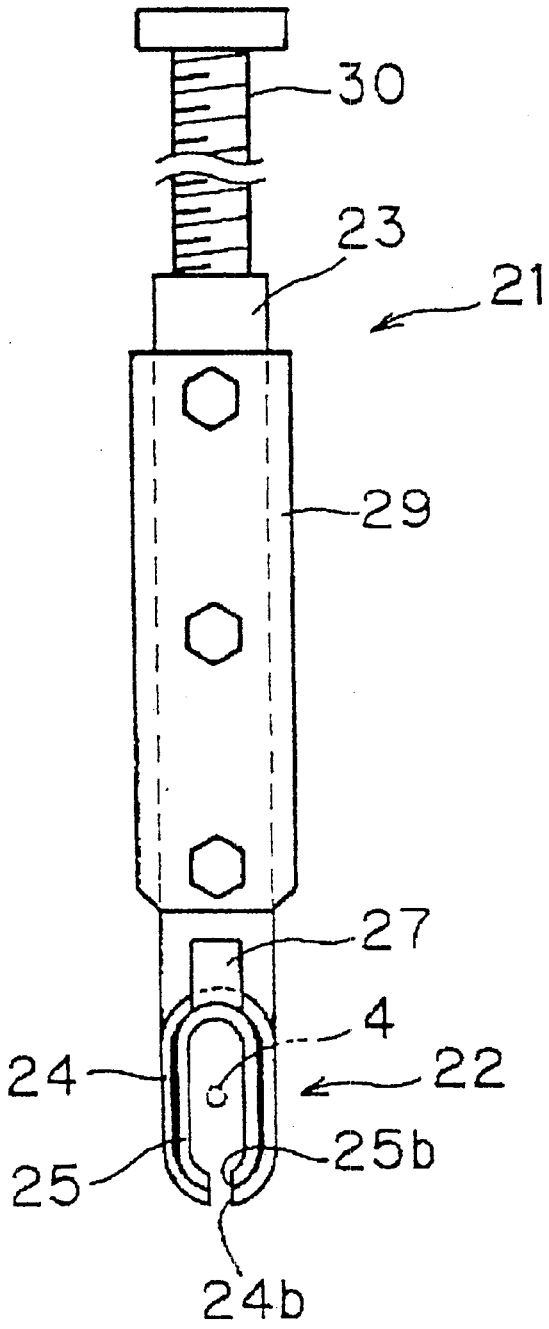
FIG. 11 is a side elevational view of the side face of an ink shield according to the present invention.
Figure 14:
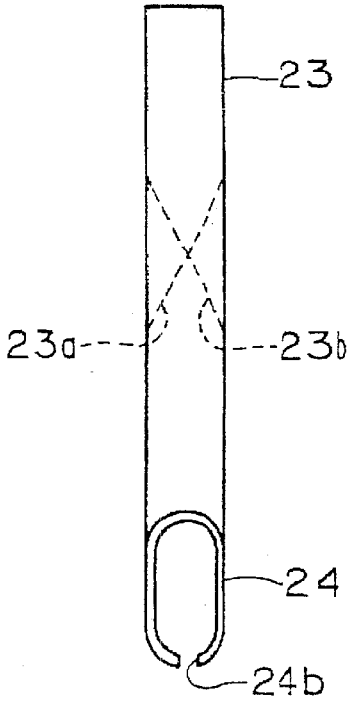
FIG. 14 is an end elevational view of the shield support of FIG. 13.

As shown in FIGS. 8, 11 and 14, the shield tube 22 includes an outer generally tubular body 24 and an inner generally tubular body 25, each having a generally oval-shaped cross-section. Both tubular bodies have a longitudinal slit at their diametrically lowermost portion, thereby forming outer slit edges and inner slit edges, and are arranged concentrically around the feed axis P. Moreover, the inner tubular body 25 is installed such that it can slide freely through the outer tubular body 24 along the feed axis P. The outer tubular body 24 and the inner tubular body 25 have a substantially similar shape with different scale, maintaining a suitable clearance, for example of about 0.1 to 0.5 mm, therebetween. Although tubular bodies 24, 25 can be displaced along the feed axis P relative to each other, they cannot be rotated around the axis P with respect to each other. The clearance between the tubular bodies 24, 25 can be determined depending on the situation.

The outer tubular body 24 may include an outer ink-orifice 24*a*, respectively at two positions along the feed axis P. Likewise, the inner tubular body 25 may include an inner ink orifice 25*a*, respectively at two positions along the feed axis P. By virtue of the sliding movement of the inner tubular body 25, ring mark printing can be started or stopped with great flexibility, respectively by communicating an outer ink-orifice 24*a* with an inner-ink orifice 25*a* (FIG. 10), or by moving the orifices apart from one another (FIG. 12).

Axial end portions of the inner tubular body 25 extend beyond the corresponding axial end portions of the outer tubular body 24. Each axial end portion of the inner tubular body 25 may then include corresponding stops 26 and 27, respectively at a diametrical upper zone thereof. The stops 26 and 27 can thus limit the sliding movement of the inner tubular body 25 relative to the outer tubular body 24, and determine the schedule between ring-mark printing production and non-printing production.

As mentioned above, the diametrically lowermost zones of the outer and inner tubular bodies include an outer longitudinal slit 24*b* and an inner longitudinal slit 25*b* that communicate with each other. Their opening is broad enough to permit the electrical cable 4 pass through, and extend in parallel relation over the feed axis P.

Figure 12:
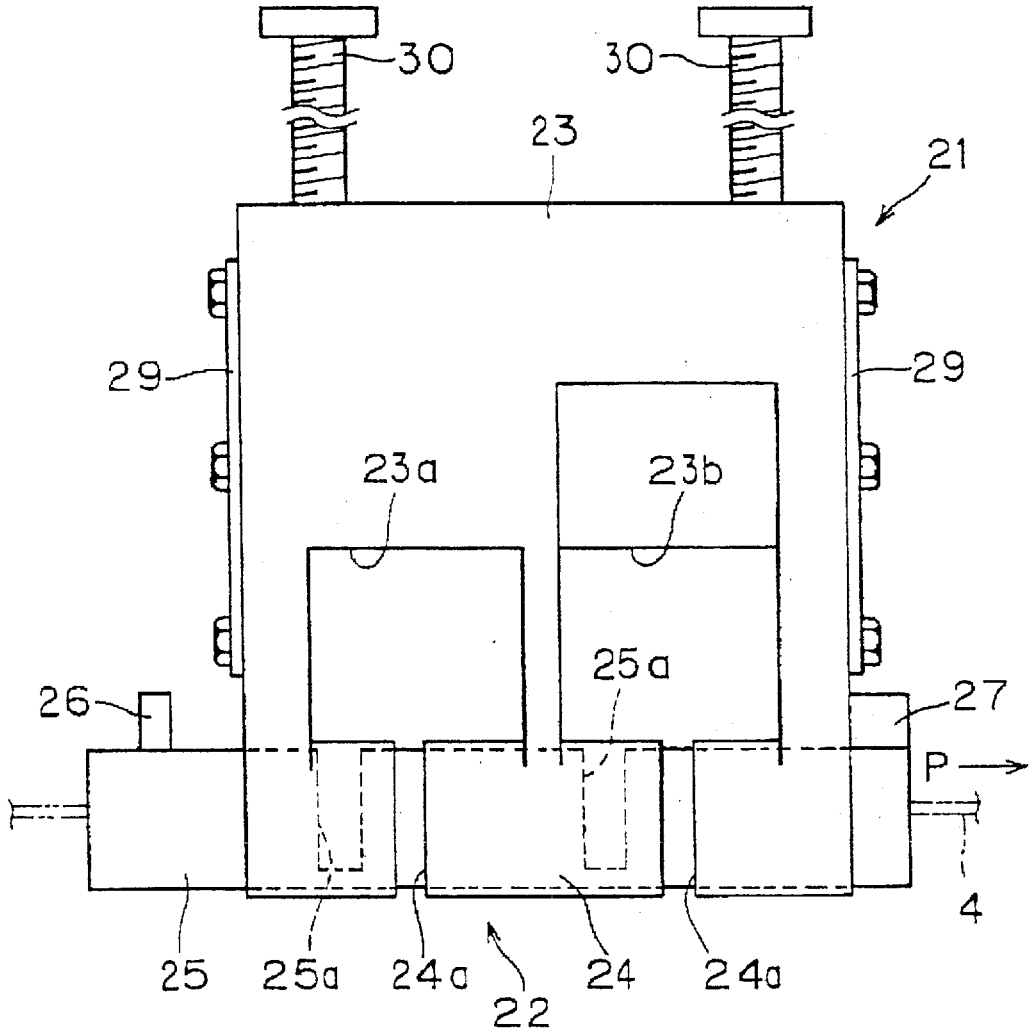
FIG. 12 is a side elevational view of the front face of an ink shield according to the present invention, when the ink orifices of the outer tubular body are moved away from those of the inner tubular body.
Figure 13:
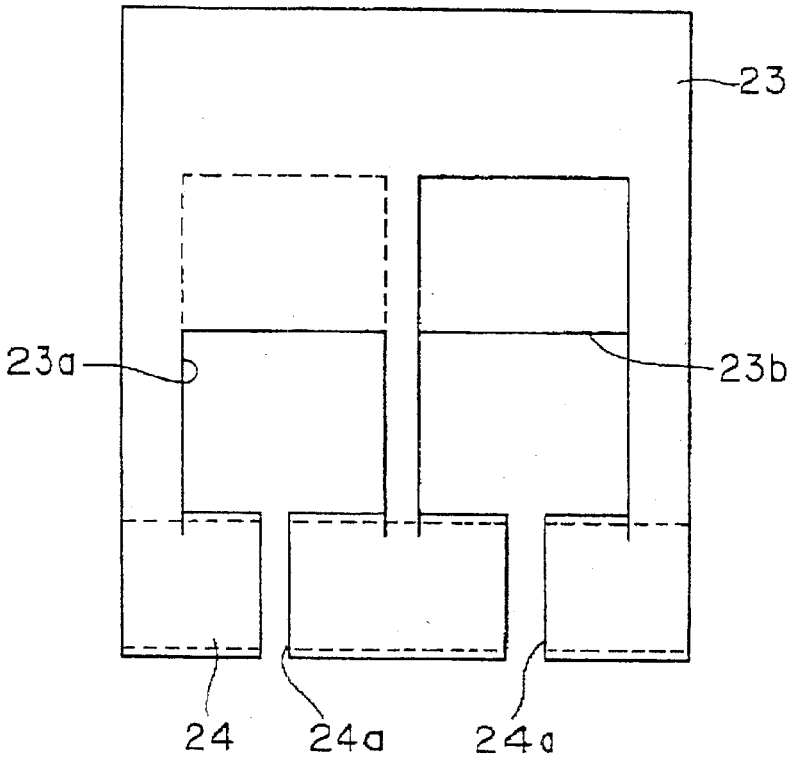
FIG. 13 is a side elevational view of a shield support and the outer tubular body connected thereto.

According to a preferred embodiment of the invention, the outer tubular body 24 is divided into three outer tubular segments along the feed axis P by two outer ink-orifices 24*a* (FIG. 12). All three outer tubular segments are integrally linked, e.g., by welding, with a rim portion of the shield support 23. The portions of shield support 23 adjacent to the outer ink-orifices 24*a* are cut out to form openings 23*a* and 23*b* having sufficient space so as not to hinder the trajectory of ejected ink 16.

Figure 15:
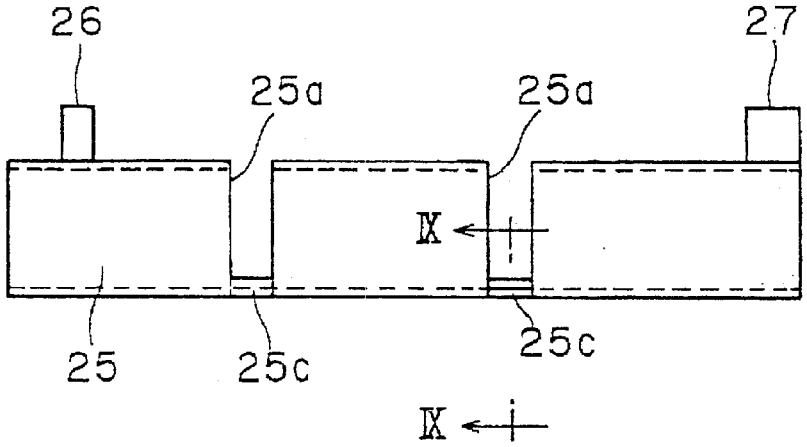
FIG. 15 is a side elevational view of an inner tubular body according to the invention.

Similarly, the inner tubular body 25 may include two inner ink-orifices 25*a*, thus defining three inner tubular segments, and each inner tubular segment is configured such that it can slide freely through a respective outer tubular segment of the outer tubular body 24. The three inner tubular segments are connected to each other through two links 25*c* (FIG. 15). Each of the links 25*c* is tied to one of the inner slit edges of inner tubular segments, which is located farthest from the marking drum 11 or 12. The width of the links 25*c* is determined as a function of the strength required for the application.

As shown in FIGS. 8 to 12, two vertical sides (in a side elevational view) of the shield support 23 are flanked with a side panel 29 and removably fixed with bolts (not numbered) thereto. In addition, the shield groove 20 is further provided with vertical sub-grooves 20*a* at the opposing ends of the shield groove 20, so that when the shield 21 is fitted into the shield groove 20 from top of the printer box 10, the side panels 29 are fitted into the sub-grooves 20*a*. In this manner, the shield support 23 is prevented from movement along the feed axis P.

Further, the upper end of shield support 23 (in a side elevational view), opposed to its bottom end where the outer tubular portion 24 is attached, is provided with a pair of shield-handling tabs 30. The shield 21 can be fitted into the printer box 10 or removed therefrom by handling, in any suitable manner, with the tabs 30. In the present embodiment, the shield-fitting tabs 30 are made from a bolt that is readily attachable or removable from the shield support 23 by screwing. However, the handling tabs 30 may be formed in any suitable manner.

Figure 16:
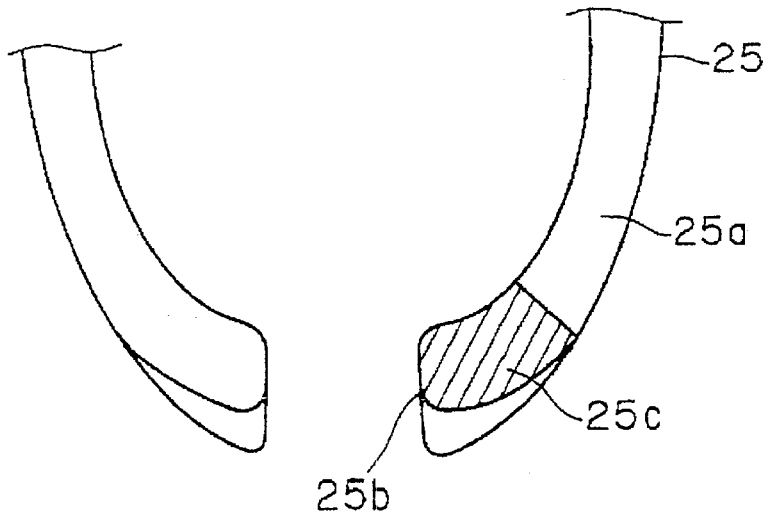
FIG. 16 is a partial cross-sectional view of the slit edges, taken along line IX in the inner tubular body of FIG. 15.

As shown in FIG. 16, the links 25*c* and their longitudinal rim zones, as well as the slit edges of the inner longitudinal slit 25*b*, are angled inwardly and made to have a more round configuration. This can be achieved by hammering the angles of the edges. Such a configuration effectively prevents the electrical cable 4 from being hooked and cut off.

As understood from the above, in the normal condition, the ink shield 21 is inserted into the shield groove 20 of the printer box 10. As shown in dotted lines in FIGS. 10 and 12, the electrical cable 4 passes along the feed axis, concentric axis for the outer tubular body 24 and inner tubular body 25.

When ring marks 17 for identifying electrical cables 4 are to be printed around electrical cables 4, the inner tubular body 25 is slid relative to the outer tubular body, until the stop 26 abuts against the end face of the shield support 23. The outer ink-orifice 24*a* and the inner ink-orifice 25*a* are thus made to communicate with each other, so that the electrical cable 4 can be printed with ring marks.

The electrical cable 4 passes through the shield tube 22 and arrives at the position where the marking drum 11 is located. Ink 16 is then ejected from the marking drum 11 by its centrifugal forces. The ink 16 is ejected through the communicated outer ink-orifice 24*a* and inner ink-orifice 25*a*, and printed on a first semicircular face of the cable 4 with a half ring mark 17*a*. The electrical cable advances and reaches the position where the marking drum 12 is located. In a similar way, the ink 16 is ejected through the communicated outer ink-orifice 24*a* and inner ink-orifice 25*a*, and printed on a second semicircular face of the cable 4 with another half ring mark 17*b*. In this manner, the electrical cable 4 is printed with completely circular ring marks 17 at predetermined intervals.

When non-marked electrical cables are to be manufactured, the inner tubular body 25 is slid in the opposite direction. The stop 27 then abuts the other end face of the shield support 23, so that the inner ink-orifice 25*a* is moved away from the outer ink-orifice 24*a*. Consequently, the outer ink-orifices 24*a* of the outer tubular portion 24 is shuttered by the inner cylinder portion 25 (FIG. 12).

The electrical cable 4 passes through the shield tube 22 and arrives at the position where the marking drum 11 is located. Ink 16 is then ejected from the marking drum 11 by its rotating forces. The ink 16 is ejected through the outer ink-orifice 24*a*, but shut out by the inner tubular portion 25, so that the ink 16 is prevented from reaching the electrical cable 4. The electrical cable advances and reaches the position where the marking drum 12 is located. In a similar way, the ink 16 is ejected through the outer ink-orifice 24*a*, but shuttered by the inner cylinder portion 25, so that the ink 16 is prevented from reaching the electrical cable 4. In this manner, electrical cables 4 without ring marks 17 are manufactured.

Switching between the production schedule for ring-marked cables and that for non-marked cables can thus be effected by merely sliding the inner tubular body 25. This one-touch operation takes only a very short time, thereby reducing the amount of unqualified products. The length loss for the electrical cable 4 does not exceed an extent of several meters.

The marking drums 11 and 12 contained in the printer box 10 are rotated without interruption, so that the clogging of ink-jet nozzles, due to solidified ink, can be prevented. Moreover, the overhauling work required in the past when restarting the production line is no longer necessary. Advantageously, switching the production module by opening or closing the outer and inner ink-orifices 24*a* and 25*a* does not involve the switching of an ink ejecting module.

Further, it is no longer necessary to install or remove the ink shield, as a function of whether or not the ring marks 17 are to be printed. This simplified operation avoids any mis-handling, such as hooking or cutting of the electrical cables 4. Instead, all that is required is to remove the shield 21 from the printer box 10, and only when maintenance work has to be done.

By virtue of the one-touch operation system as explained above, length loss of the cables 4 is drastically reduced. Moreover, the cables 4 with or without ring marks 17 can be produced continuously in the same production schedule. The system of the invention is well adapted to a small lot production and improves running rates of the production line.

Further, the links 25*c* bridging the inner ink-orifices 25*a* of the inner tubular body 25 may be formed on one of the inner slit edges, located farthest from the marking drum 11 or 12, so that ink 16 ejected from the marking drum 11 or 12 will not detoured by the links 25*c*. Printing performance of the ring marks 17 on the electrical cable 4 is thus further improved. Of course, the links 25*c* may be formed on both the inner slit edges, if desired.

In the above embodiment, the outer tubular body 24 and inner tubular body 25 of the shield tube 22 respectively have an oval-shaped cross-section. However, the tubular bodies 24, 25 may have any suitable shape, for example, round, square, etc., as long as the two tubular bodies 24 and 25 are prevented from rotating relative to each other.

Further, in the above embodiment, the stops 26 and 27 are mounted on the inner tubular body 25. Alternatively, they may be mounted on the outer tubular body 24.

As can be understood from above, according to the ring mark printing device for identifying electrical cables of the present invention, the printer box contains an ink shield including concentrically placed outer and inner tubular bodies. The outer and inner tubular bodies surround, from a certain distance away, an electrical cable which passes through the printer box along the cable feed axis. Further, the outer tubular body includes outer ink-orifices at positions placed in the trajectory of the ink ejected from the marking drums. Likewise, the inner tubular body includes inner ink-orifices, and is mounted inside the outer tubular body in a freely slidable way along the feed axis. The outer and inner ink-orifices can be superposed by sliding the inner tubular body relative to the outer tubular body, so that the electrical cable can receive ejected ink. Alternatively, the inner ink-orifices can be moved relative to the outer ink-orifice by sliding the inner tubular body, so that the electrical cable is prevented from receiving ejected ink. Switching of the schedule between mark-on mode and mark-off mode can be done by a one-touch operation, i.e. merely by sliding the inner tubular body. The switching time thus becomes very short, so that the length loss of electrical cables, arising from the generation of substandard products, is drastically reduced.

Further, as the printer box is operated without interruption, there are no longer problems due to ink solidification, machine readjusting upon restarting, or ink scattering.

Further yet, there is no need for assembling or disassembling the device components, depending on whether ring marks are to be printed or not. Accordingly, inconveniences due to the mounting work, e.g. an inadvertent hooking or severing of the electrical cables, can be avoided.

Moreover, since the hybrid production of marked and unmark electrical cables can be carried out continuously and length loss of the cables can be reduced, the production schedule can be adapted more easily to a small lot production. As a consequence, running rates of the production line can be improved.

Furthermore, the diametrically lowermost portions of the respective outer and inner tubular bodies are provided with a corresponding longitudinal slit in parallel relation over the feed axis of the electrical cable. These slits are superposed relative to each other, and have a space sufficient to admit the electrical cable into the inner tubular body. In this manner, the ink shield can be inserted into the printer box from the upper side thereof, or removed therefrom, in an easily transformable way. Maintenance of the printer box is thus greatly facilitated.

Furthermore, in a preferred embodiment, the outer tubular body is divided into three outer segments by two outer ink-orifices, while the inner tubular body is divided into three inner segments by two inner ink-orifices. The inner tubular body is then maintained in the outer tubular body such that it can slide through the three outer segments. Further, the three inner segments are preferably linked through only one of the slit edges located farthest from the ink-jet nozzles. Thus, the link portions do not therefore impede the ink trajectory when the ring marks are printed.

In addition, the sliding movement of the inner tubular body is defined by positioning the stops, such that the marking position and the unmarking position are also determined. The production schedule can thus be changed very easily by a simple sliding operation.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. 2000-013753, filed on Jan. 24, 2000, which is herein expressly incorporated by reference in its entirety.

What is claimed:

1. A ring-mark printing device for identifying electrical cables, the device comprising: a printer box having a feed axis and configured to pass an electrical cable along the feed axis; a pair of marking drums each having a respective outer circular face, the marking drums being contained in the printer box and arranged in staggered positions along the feed axis and spaced a given distance therefrom, the marking drums including ink-jet nozzles at the outer circular face; wherein the marking drums are respectively configured to contain ink and eject the ink through the ink-jet nozzles by virtue of centrifugal forces exerted by drum rotation, in order to print a ring-mark around the peripheral surface of the electrical cable;

wherein said printer box is provided with an ink shield comprising substantially concentrically placed outer and inner tubular bodies which are configured to surround the electrical cable at a predetermined distance spaced therefrom, said outer tubular body comprising at least one outer ink-orifice at a position facing one of the marking drums and said inner tubular body comprising at least one inner ink orifice; and said inner tubular body is mounted to freely slide within said outer tubular body along said feed axis, such that said at least one inner ink-orifice can be aligned with a corresponding one of said at least one outer ink-orifices to permit ring-mark printing, or moved from alignment with said corresponding one of said at least one outer ink-orifices to prevent ring-mark printing.

2. The ring-mark printing device according to claim 1, wherein said outer tubular body is divided into three outer tubular segments by two outer ink-orifices, and said outer tubular segments are fixed to a shield support.

3. The ring-mark printing device according to claim 2, wherein said shield support has an opening in a portion adjacent to said outer ink-orifice.

4. The ring-mark printing device according to claim 3, wherein said inner tubular body is divided into three inner tubular segments by two inner ink-orifices, and said inner tubular segments are connected to each other by at least one linking element.

5. The ring-mark printing device according to claim 2, wherein said inner tubular body is divided into three inner tubular segments by two inner ink-orifices, and said inner tubular segments are connected to each other by at least one linking element.

6. The ring-mark printing device according to claim 2, wherein said outer and inner tubular bodies comprise a corresponding outer and inner longitudinal slit along a diametrically lowermost portion over the respective lengths thereof, and said outer and inner longitudinal slits communicate with each other and have a space sufficiently large for allowing the electrical cable to pass, such that said ink shield can be fitted into the printer box from the top thereof in a freely engageable and removable way.

7. The ring-mark printing device according to claim 2 wherein said inner tubular body comprises at least one stop, such that, when said inner tubular body is slid through said outer tubular body, said at least one stop determines one of a position ready for ring-mark printing and a position for impeding the ring-mark printing.

8. The ring-mark printing device according to claim 7 wherein said inner tubular body is longer than said outer tubular body, so that two end portions of said inner tubular body extend outwardly from two end portions of said outer tubular body along said feed axis, and said two end portions of said inner tubular body carry respectively first and second stops, such that said inner tubular body determines a position ready for ring-mark printing and for impeding the ring-mark printing, by sliding said inner tubular body until one of said first and second stops abuts against said outer tubular body.

9. The ring-mark printing device according to claim 1, wherein said outer tubular body is fixed to a shield support, and said shield support has an opening in a portion adjacent to said at least one outer ink-orifice.

10. The ring-mark printing device according to claim 9, wherein said inner tubular body is divided into three inner tubular segments by two inner ink-orifices, and said inner tubular segments are connected to each other by at least one linking element.

11. The ring-mark printing device according to claim 1, wherein said inner tubular body is divided into three inner tubular segments by two inner ink-orifices, and said inner tubular segments are connected to each other by at least one linking element.

12. The ring-mark printing device according to claim 11, wherein said outer and inner tubular bodies comprise a corresponding outer and inner longitudinal slit along a diametrically lowermost portion over the respective lengths thereof, and said outer and inner longitudinal slits communicate with each other and have a space sufficiently large for allowing the electrical cable to pass, such that said ink shield can be fitted into the printer box from the top thereof in a freely engageable and removable way.

13. The ring-mark printing device according to claim 11, wherein said inner longitudinal slit comprises first and second longitudinal rims, which are divided into corresponding first and second rim segments by said inner ink-orifices, said first rim segments are positioned relative to one of the marking drums farther than said second rim segments, and said linking element is mounted between two adjacent first rim segments.

14. The ring-mark printing device according to claim 11 wherein said inner tubular body comprises at least one stop, such that, when said inner tubular body is slid through said outer tubular body, said at least one stop determines one of a position ready for ring-mark printing and a position for impeding the ring-mark printing.

15. The ring-mark printing device according to claim 14 wherein said inner tubular body is longer than said outer tubular body, so that two end portions of said inner tubular body extend outwardly from two end portions of said outer tubular body along said feed axis, and said two end portions of said inner tubular body carry respectively first and second stops, such that said inner tubular body determines a position ready for ring-mark printing and for impeding the ring-mark printing, by sliding said inner tubular body until one of said first and second stops abuts against said outer tubular body.

16. The ring-mark printing device according to claim 1, wherein said outer and inner tubular bodies comprise a corresponding outer and inner longitudinal slit along a diametrically lowermost portion over the respective lengths thereof, and said outer and inner longitudinal slits communicate with each other and have a space sufficiently large for allowing the electrical cable to pass, such that said ink shield can be fitted into the printer box from the top thereof in a freely engageable and removable way.

17. The ring-mark printing device according to claim 16, wherein said inner longitudinal slit comprises first and second longitudinal rims, which are divided into corresponding first and second rim segments by said inner ink-orifices, said first rim segments are positioned relative to one of the marking drums farther than said second rim segments, and said linking element is mounted between two adjacent first rim segments.

18. The ring-mark printing device according to claim 16 wherein said inner tubular body comprises at least one stop, such that, when said inner tubular body is slid through said outer tubular body, said at least one stop determines one of a position ready for ring-mark printing and a position for impeding the ring-mark printing.

19. The ring-mark printing device according to claim 1 wherein said inner tubular body comprises at least one stop, such that, when said inner tubular body is slid through said outer tubular body, said at least one stop determines one of a position ready for ring-mark printing and a position for impeding the ring-mark printing.

20. The ring-mark printing device according to claim 19 wherein said inner tubular body is longer than said outer tubular body, so that two end portions of said inner tubular body extend outwardly from two end portions of said outer tubular body along said feed axis, and said two end portions of said inner tubular body carry respectively first and second stops, such that said inner tubular body determines a position ready for ring-mark printing and for impeding the ring-mark printing, by sliding said inner tubular body until one of said first and second stops abuts against said outer tubular body.

* * * * *